US007837078B2

(12) United States Patent
Clark et al.

(10) Patent No.: US 7,837,078 B2
(45) **Date of Patent: *Nov. 23, 2010**

(54) PLANK TOP SET TOOL FOR HARDWOOD PLANK STAPLES

(75) Inventors: Jack Clark, Buffalo, MN (US); Scott Marschel, Maple Lake, MN (US)

(73) Assignee: Crain Cutter Company, Inc., Milpitas, CA (US)

( * ) Notice: Subject to any disclaimer, the term of this patent is extended or adjusted under 35 U.S.C. 154(b) by 128 days.

This patent is subject to a terminal disclaimer.

(21) Appl. No.: 12/324,650

(22) Filed: Nov. 26, 2008

(65) Prior Publication Data

US 2010/0127037 A1 May 27, 2010

(51) Int. Cl.
*B25C 7/00* (2006.01)

(52) U.S. Cl. ..... 227/148; 227/147; 227/119; 227/107

(58) Field of Classification Search ..... 227/147, 227/148, 119, 120, 130, 156, 107
See application file for complete search history.

(56) References Cited

U.S. PATENT DOCUMENTS

| | | | | | |
|---|---|---|---|---|---|
| 1,016,383 | A | | 2/1912 | Wellman | |
| 1,213,334 | A | | 1/1917 | Chapman | |
| 2,768,376 | A | * | 10/1956 | Critchley | 173/31 |
| 3,012,247 | A | * | 12/1961 | Sillars et al. | 227/121 |
| 3,360,176 | A | * | 12/1967 | Gehl et al. | 227/148 |
| 3,764,053 | A | * | 10/1973 | Thompson | 227/111 |
| 3,864,053 | A | * | 2/1975 | Harwood | 408/110 |
| 4,084,738 | A | * | 4/1978 | Schneider | 227/7 |
| 4,085,382 | A | | 4/1978 | Barber et al. | |
| 4,196,833 | A | * | 4/1980 | Haytayan | 227/8 |
| 4,450,998 | A | | 5/1984 | Ruskin | |
| 4,838,471 | A | | 6/1989 | Chiesa | |
| 4,858,813 | A | | 8/1989 | Wingert | |
| 4,903,882 | A | | 2/1990 | Long | |
| 4,907,730 | A | * | 3/1990 | Dion | 227/8 |
| 5,062,562 | A | * | 11/1991 | Michael | 227/111 |
| 5,868,183 | A | * | 2/1999 | Kozyrski et al. | 144/136.1 |
| 5,967,397 | A | | 10/1999 | Fealey | |
| 6,155,472 | A | * | 12/2000 | Deziel | 227/8 |
| 6,269,996 | B1 | * | 8/2001 | McAllister | 227/7 |
| 6,318,620 | B1 | * | 11/2001 | Anstett et al. | 227/147 |
| 6,527,156 | B2 | * | 3/2003 | McAllister et al. | 227/7 |
| D493,079 | S | | 7/2004 | Fowler | |
| 6,843,402 | B2 | * | 1/2005 | Sims et al. | 227/148 |
| 7,243,832 | B2 | | 7/2007 | Jiang | |
| 7,255,256 | B2 | * | 8/2007 | McGee et al. | 227/8 |
| 7,303,105 | B2 | | 12/2007 | Dion et al. | |
| 2007/0017953 | A1 | * | 1/2007 | Hamar | 227/8 |
| 2007/0057013 | A1 | * | 3/2007 | Deziel | 227/147 |
| 2007/0257081 | A1 | * | 11/2007 | Dion et al. | 227/148 |
| 2008/0296341 | A1 | * | 12/2008 | Francescon | 227/119 |

* cited by examiner

*Primary Examiner*—Brian D Nash
(74) *Attorney, Agent, or Firm*—Schneck & Schneck; David M. Schneck

(57) ABSTRACT

A plank top set tool for driving hardwood staples including a body having an underside base surface which contacts a base top and an angled stop surface fitting over the vertical surface leading to the tongue base. Extending at a 45 degree angle through the block is a staple slot bore having a staple slot width. A rod is insertable into the bore and has a first end acting as a hammering head to receive an impact force and a second end configured to receive a staple head and transfer the force.

21 Claims, 11 Drawing Sheets

PLANK TOP SET TOOL FOR HARDWOOD PLANK STAPLES

TECHNICAL FIELD

The present invention relates to flooring tools and more specifically to tools for setting hardwood plank staples.

BACKGROUND

In the installation of tongue and groove hardwood plank flooring materials, pneumatic staplers are commonly used to drive staples used to adhere the planks to the floor. These staplers are designed to sit flat on top of the hardwood plank and locate against a tongued side of the plank such that they can precisely drive the staple at a 45° angle at a point just above the tongue. The driving angle of 45° and driving elevation at the point just above the tongue are fixed and standard for most modern pneumatic hardwood staplers. The standard angle and point of entry for driving staples works well because the hardwood planks themselves normally have standard tongue and groove dimensions.

FIG. 8 shows the shape of a typical modern hardwood staple 50. As used herein, a typical hardwood staple 50 has dimensions defined as follows: dimension 51 is the length of the hardwood staple (sometimes also referred to as a "leg"), dimension 52 is the width of the hardwood staple (sometimes also referred to as a "crown"), and dimension 53 is the thickness of the hardwood staple. Modern hardwood staples are typically wire form products made from round wire. Hence the crown 52 of this kind of staple tends to form a longitudinally rounded surface 54. In comparison to other staples, modern hardwood flooring staples have long, brittle legs that will easily break if they are not supported during the driving process.

FIG. 5 illustrates by way of a cross sectional view the proper stapling of a tongue and groove hardwood plank. A first plank 11 has a hardwood staple 12 driven fully at a 45° angle into the vertex 13 of the exterior angle formed by an outer edge 14 and a tongue 15 of first plank 11. Hardwood staple 12 anchors first plank 11 to subfloor 16. Provided hardwood staple 12 is fully driven into the vertex 13 of first plank 11, the tongue 15 of plank 11 fits easily into groove 18 of second plank 17, and the stapling process continues by stapling at same area of the next plank (vertex 19 of second plank 17).

As shown in FIG. 10, the exterior angle formed by tongue outer edge 74 on the tongued side of the plank and a tongue 75 of a typical hardwood plank 71 may not be a 90° angle. The angle D formed between tongue outer edge 74 and tongue 75 is normally about 89.5°. Similarly, groove outer edge 70 on the opposite groove side of the plank is at an angle E of about 88.5° in relation to a centerline 71 of the plank 11. As shown in FIG. 11, these angles relieve tongue outer edge 74 and groove outer edge 70 from each other when butted together. This ensures tongue outer edge 74 and groove outer edge 70 will only contact near tongue top edge 72, and groove top edge 73. This ensures that there will be minimal interference between the edges which could create a gap at the top of the joint.

In the use of pneumatic hardwood staplers, knots in the hardwood plank or drops in air pressure may cause the nailer to only partially drive the staple, leaving an undesirable exposed staple head. FIG. 6 illustrates the problem. Hardwood staple 10 has been partially driven into the side of the hardwood plank, leaving an exposed staple head 2. Whenever there is an exposed staple head, the tongue of a first plank and the groove of the next plank will not fit together. The floor installation process comes to a halt.

Presently, hardwood installers normally carry snips and conventional nail sets to hammer down partially driven staples. The staple legs have to be separated from the crown, and then the legs can be driven using a conventional nail set. This is a difficult, time consuming process. If a set tool were available to drive the entire exposed staple head the rest of the way into the side of the plank, it would greatly speed the process of installation. The process of driving a partially driven staple or exposed staple head will be referred to herein as a process of "finish hammering" the hardwood staple.

Tools have been developed for hammering nails into the side of tongue and grooved flooring materials, but none for finish hammering modern hardwood staples from pneumatic staplers. For example, U.S. Pat. No. 1,016,383 to Wellman discloses a set tool with a plate which sits flat on the hardwood plank. The plate includes a "V-rib" or 90° internal angle surface formed in its base. The V-rib is shaped to conform to the plank at the exterior angle formed by the outer edge of the plank and the tongue of the plank (also referred to as a "rabbet" as this term is used in woodworking). Thus, the V-rib functions to position the plate at a precise location "to permit the effective drive of nails". A circular "passage" for inserting a round headed nail is formed at a 45° degree angle through the plate to the vertex of the V-rib. Thus, when the point of the nail is inserted into the passage, it is automatically located at the optimal location for driving the nail at a 45° angle into the side of the plank.

In addition, the disclosed device includes a "punch or driving element" for use in connection with the plate. The punch is a generally cylindrical rod with a reduced outside diameter on one end which can slidably fit within the passage in the plate. This reduced diameter end can slide within the passage all the way to the bottom of the passage, and can thus drive the nail all the way down to the bottom of the passage. Thus, as this disclosure states, "the nail can be entirely driven into the flooring without removing the improved implement" (i.e., the "plate").

Wellman's floor set may have worked well for the purpose of driving nails, but it is not suitable for the purpose of finish-hammering partially driven modern hardwood staples. The reason is that the passages are merely cylindrical holes designed for the passage of round headed nails. In comparison, modern hardwood staples are fairly thin, U-shaped metal wire form products. Effectively driving such staples requires that the staple be precisely supported all the way into the material by means of a precision staple channel that is shaped to create a precision slide fit with the dimensions of the staple. If a user attempted to drive such a staple with only a hammer, the lack of support means would cause the thin metal legs of the staple to bend over or break. The passage of the Wellman device will not provide the necessary precision support means for supporting the staple.

Other prior art set tools have been developed for driving staples, but they all have drawbacks. U.S. Pat. No. 1,213,334 to Chapman discloses a single-piece driving rod type staple set with a plurality of "sockets" (i.e., "blind-hole" staple channels) of varying depths formed in its driving head. The reference states that "the sockets are made of gradually decreasing depths so as to accommodate the staple at various stages of its entrance into the wood in which it is being set." Thus, the user begins by inserting a staple in the deepest channel, and hammers on the opposite end to start the driving process. Once the driving head contacts the wood, the user inserts the staple head into one of the shallower sockets, and the staple can be driven further. The legs of the staple are supported by the various sockets, preventing them from spreading or bending over. This device is not suitable for the purpose of finish hammering hardwood staples because the plurality of sockets requires a wide head. Such a wide head does not easily enter the exterior angle formed by the outer edge of the plank and the tongue of the plank. Furthermore, modern hardwood staples are by comparison much longer and thinner than the staples shown by Chapman. More sockets of even greater depth would be necessary, and the sockets would need to be thinner. Forming enough thin blind sockets into the head would become impractical. Finally, there is no means to maintain the prescribed 45° angle during the finish hammering process. What is needed is a tool with a single staple slot with a length at least as long as the hardwood staple, and a means of driving the head of the hardwood staple down the length of the staple channel. The staple channel could be formed at the prescribed 45° angle.

Other similar set tools, such as that disclosed in U.S. Patent #D493079 S to Fowler, have more compact, relieved driving heads which include a single staple socket. Such a compact driving head can more easily enter the exterior angle formed by the outer edge of the plank, and the tongue of the plank. However, there is no means of support for the legs of the staple. This type of tool is not helpful in cases where the staple protrudes a significant distance from the hardwood plank. Without support during the driving process, the staple simply bends over.

What is needed is a set tool for finish hammering modern hardwood staples which properly supports the legs of these staples throughout the process of finish hammering while also maintaining the prescribed 45° angle and location on the plank where such staples are normally driven.

SUMMARY

The device is a set tool including a block-like body with a staple slot formed within said body, and a separate driving rod to drive the staple. The body may sit on the face of the hardwood plank on a body base surface. The body further includes a downwardly extending arm. On its inside surface, the arm forms a stop surface for the set tool. The external angle formed by the body base surface and the stop surface is preferred to be about 75°. This angle relieves the stop surface from the outside edge of the plank (approximately 89.5° external angle in relation to the tongue), and prevents impact of the set tool at the top edge of the plank (which can cause chipping). The stop surface extends to a location where it forms a staple insertion edge with an arm base surface. The extension of the stop surface places the staple insertion edge at the vertex of the external angle formed by the outer edge of the hardwood plank, and the tongue of the plank. The arm base surface is parallel to the body base surface, and rests on top of the tongue of the plank. A staple slot is formed at the prescribed 45° angle within the body, and ending at the staple insertion edge. In use, the partially driven hardwood staple is inserted in the staple slot. The body base surface is then set on the hardwood plank. The extension and angle of the stop surface places the staple insertion edge at the vertex of the external angle formed by the outer edge of the plank, and the tongue of the plank. The user inserts the rod in the staple slot. The user slides the rod in the staple slot until it contacts the head of the staple. The user hammers the rod with a hammering tool, and the staple is driven into the hardwood plank at the prescribed angle and location. Support from the precision staple slot ensures the staple will not bend over during the process of finish hammering.

DETAILED DESCRIPTION OF THE INVENTION

Figure 1:
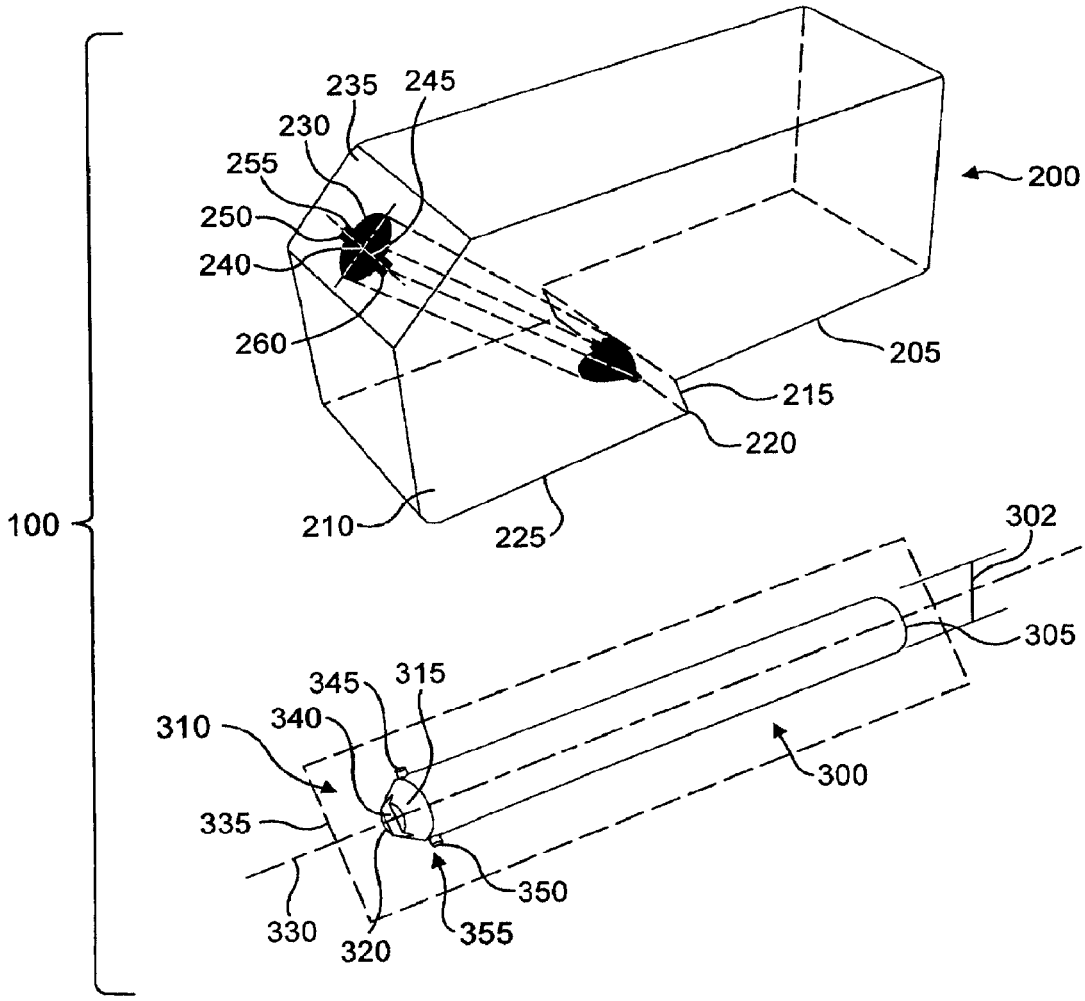
FIG. 1 is a disassembled perspective view of the set tool showing the body and the driving rod.
Figure 2:
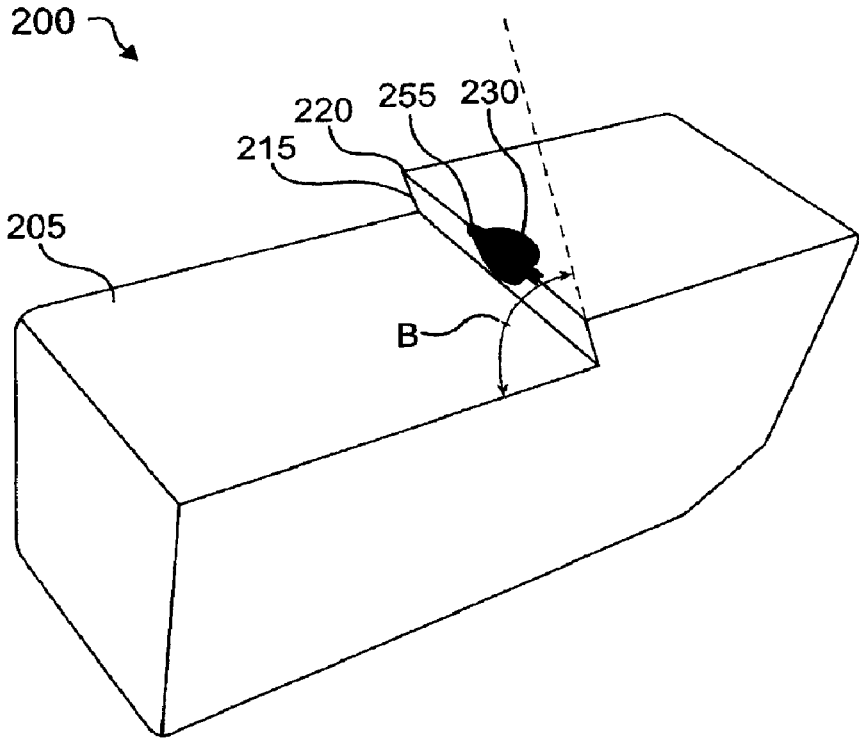
FIG. 2 is a bottom perspective view of the set tool body.
Figure 7:
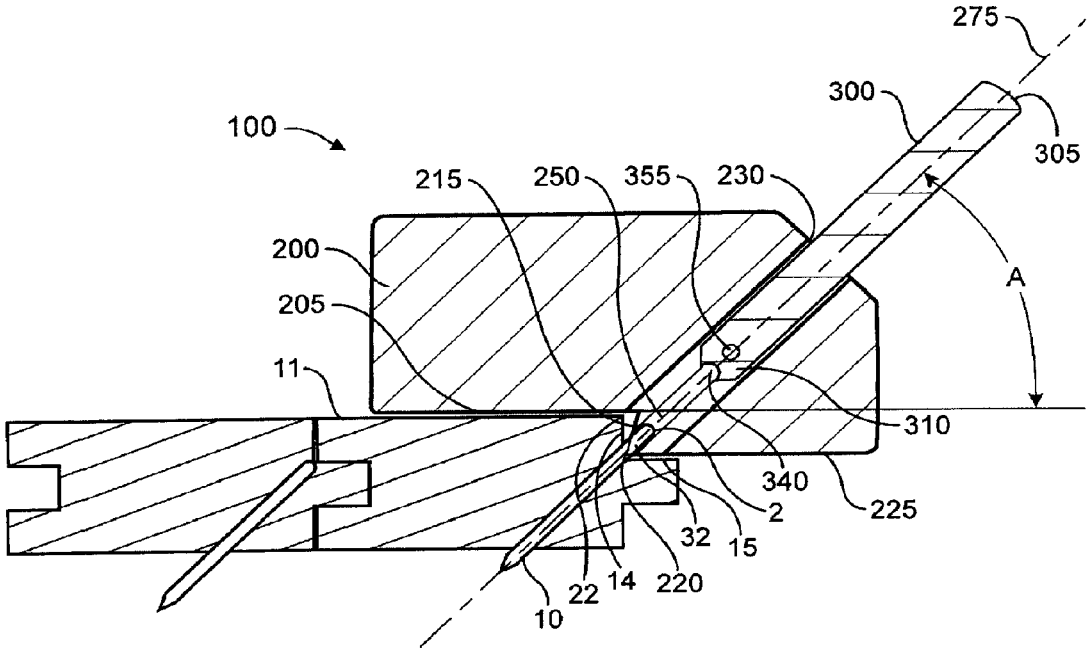
FIG. 7 is a vertical cross section of the set tool bisecting the 45° angle hole to show the insertion of an exposed staple head.
Figure 8:
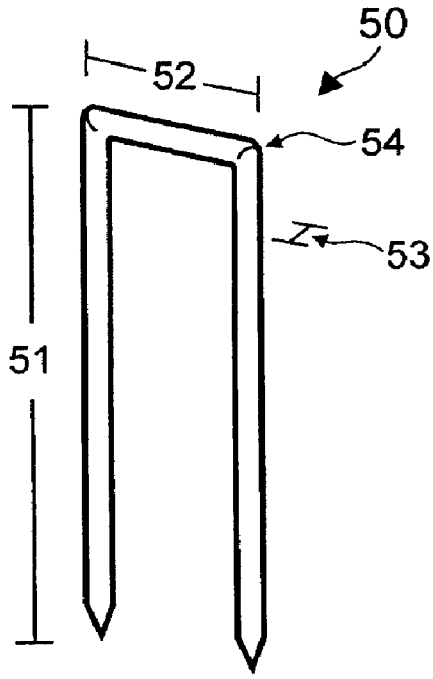
FIG. 8 is a perspective view of a typical hardwood staple.

As shown in FIG. 1, set tool 100 includes a block-like body 200 and a rod 300. Body 200 includes a flat body base surface 205 for setting body 200 flat on the face of a hardwood plank, and an arm 210 extending downward to form a stop surface 215. As shown in FIG. 2, a bottom view of body 200, stop surface 215 forms an external angle B in relation to body base surface 205. Angle B could be any angle in the area of 90° corresponding roughly to the shape of the external angle formed by outside edge of the hardwood plank, and the tongue of the plank (approximately 89.5°). However, it is preferred that this angle B be about 75°. As shown in FIG. 7, such an angle causes stop surface 215 to be slightly relieved from outer edge 14 and top edge 22 of a plank. This ensures that when the outer edge of the hardwood plank is placed up next to stop surface 215, stop surface 215 will not contact the top edge 22 of the plank 11. This prevents the top edge of the hardwood plank from being chipped by impacts from the body.

As shown in FIG. 1, arm base surface 225 intersects stop surface 215 to form a staple insertion edge 220. Arm base surface 225 is parallel to body base surface 205. As shown in FIG. 7, the angled extension of stop surface 215 places a staple insertion edge 220 precisely at the vertex of the external angle formed by the outer edge 14 of the plank, and the tongue 15 of the plank. This is precisely the point in the plank from which that an exposed staple head normally extends.

As shown in FIG. 1, a 45° hole 230 is formed extending from top surface 235 in body 200 through to staple insertion edge 220. As used herein, the measurement of angle of 45° used to describe 45° hole 230 is illustrated in FIG. 7. The angle A formed by the plane formed by body base surface 205 and a centerline 275 of 45° hole 230 is about 45°.

As shown in FIG. 1, 45° hole 230 is a round hole. 45° hole 230 has a center 240. Center 240 forms one end of a centerline of 45° hole 230 that extends downward at an angle of 45° and ends precisely at staple insertion edge 220. Thus, when viewed from center 240, 45° angle hole 230 is bisected by a 45° plane extending upwards from the line formed by staple insertion edge 220 to center 240. Also in this plane is a "bisecting diameter" 245 of 45° hole 230. The plane between staple insertion edge 220 through bisecting diameter 245 (and through center 240) will be referred to herein as the "45° bisecting plane" of hole 230.

The shape of 45° hole 230 could be any shape, including, at a minimum, a rectangular shape having a slightly greater width and thickness to permit a precise slide fit with an exposed head of a typical hardwood staple. However, a round hole is preferred so that it may be formed using a standard drill. 45° hole 230 is sized to accommodate a cylindrical rod 300 having a hammering head 305 with a thickness 302 greater than that of the thickness of a typical hardwood staple. A thicker hammering head 305 is preferred because it is easier to strike and will not bend as easily as a rod that was only the thickness of a typical hardwood staple. However, 45° hole 230 (and rod 300) are preferably not wider than the width of a typical hardwood staple. This is so a staple slot 250 can be formed by the addition of two parallel rectangular channels 255, 260. Channels 255, 260 have a precise width and thickness such that they together form a rectangular staple slot 250. The shape of staple slot 250 creates a precise slide fit to accept and support an exposed staple head during the process of finish hammering.

Channels 255, 260 have their center on the same center 240 as 45° hole 230 and are thus bisected by the same 45° bisecting plane. Channels 255, 260 are formed in 45° angle hole 230 all the way down to staple insertion edge 220. Thus, channels 255, 260 and staple slot 250 are also bisected by the line formed by staple insertion edge 220. As more clearly shown in FIG. 2, a bottom view, 45° angle hole 230 and staple slot 255 are both bisected by the line formed by staple insertion edge 220, placing the staple slot at the optimal location for receiving an exposed hardwood staple head.

Figure 3:
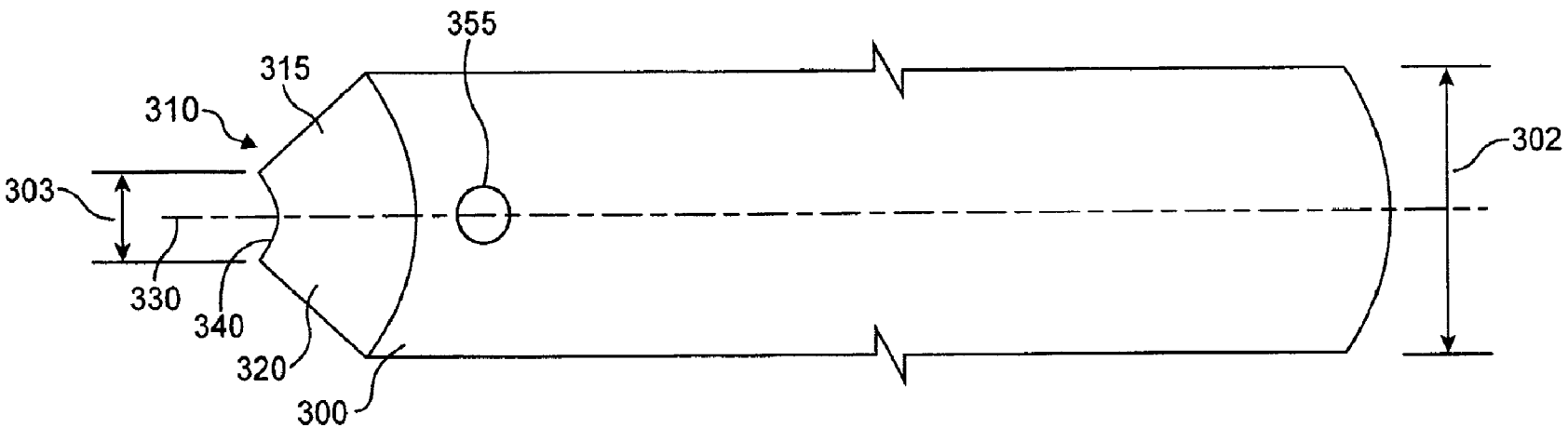
FIG. 3 is a detailed side view of the rod.

As shown in FIG. 1, set tool 100 includes a cylindrical rod 300 with an outside diameter 302 that slides within the 45° angle hole 230. Rod 300 has a centerline 330 and is bisected by a plane 335 through a diameter of rod 300. Rod 300 has a hammering head 305 on one end, and a staple driving head 310 on its opposite end. Staple driving head 310 has relieved edges 315, 320. As shown in greater detail in FIG. 3, relieved edges 315, 320 form an included angle in the area of 75-90°. The vertex of this included angle is centered on centerline 330 of rod 300. Relieved edges 315, 320 allow staple driving head 310 to enter the external angle formed by the outer edge of the hardwood plank, and the tongue of the plank. As shown in FIG. 1, a staple receiving groove 340 is formed in driving head 310 for receiving an exposed staple head. As shown in FIG. 3, staple receiving groove 340 is bisected by centerline 330. As shown in FIG. 1, staple receiving groove 340 is also bisected by plane 335.

As previously explained, the thickness of rod 300 is greater than the thickness of a typical hardwood staple. As shown in FIG. 3, the full thickness 302 of rod 300 is greater than the thickness of a typical hardwood staple. The width of the staple is approximately represented by staple receiving groove 340 (dimension 303).

As shown in FIG. 1, near staple driving end 310 are two guide nubs 345, 350. Guide nubs 345, 350 are formed by insertion of a cylindrical pin 355 through a hole just behind staple receiving groove 340. As shown in FIG. 3, cylindrical pin 355 is centered on and bisected by the same centerline 330 as staple receiving groove 340. Thus, as shown in FIG. 1, pin 355 and guide nubs 345, 350 will also be bisected by plane 335.

Figure 4:
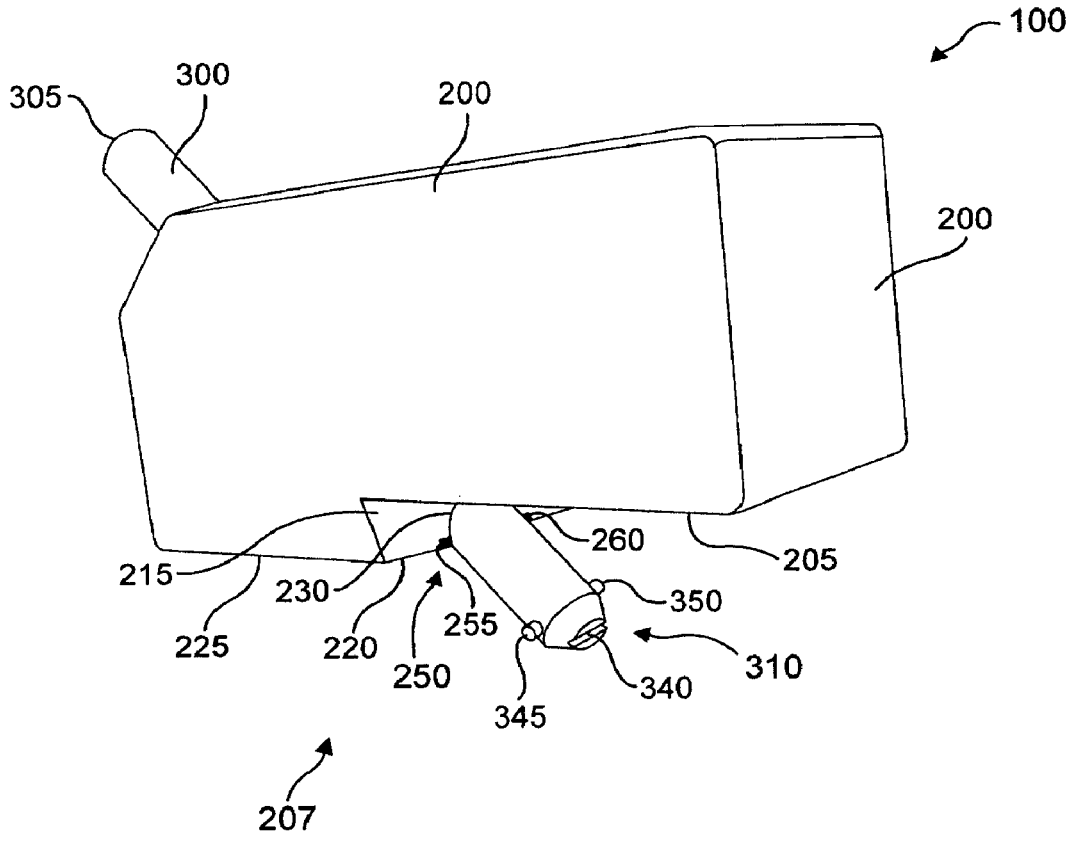
FIG. 4 is an assembled view of the set tool.
Figure 5:
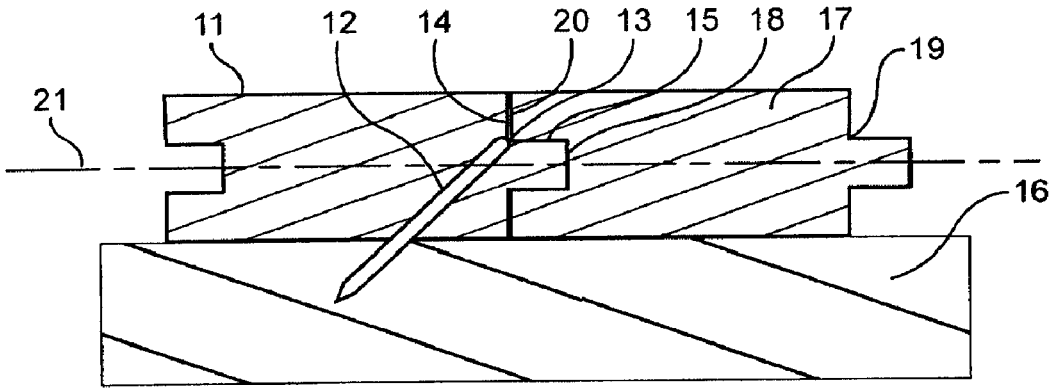
FIG. 5 is a cross-sectional view of a hardwood plank showing a properly driven hardwood staple.
Figure 6:
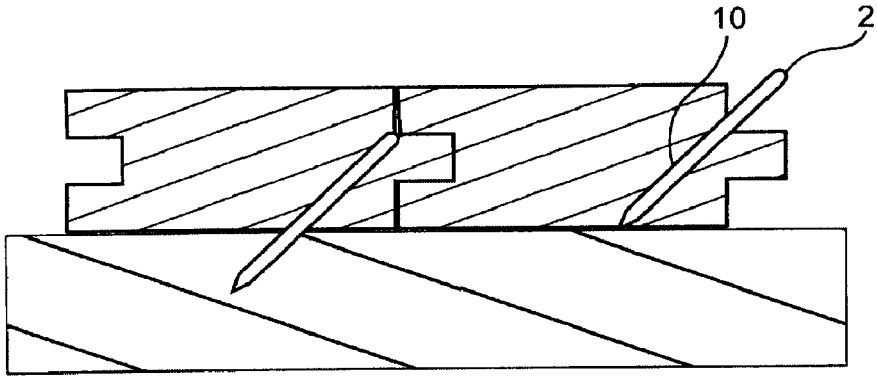
FIG. 6 is a cross-sectional view of an exposed staple head in a hardwood plank.

As shown in FIG. 4, when set tool 100 is assembled, rod 300 is slidably inserted into 45° hole 230 in body 200. Guide nubs 345, 350 extend from rod 300 such that they may enter the two channels 255, 260 forming staple slot 250 inside 45° hole 230. The staple driving end 310 of rod 300 is guided by guide nubs 345, 350 to the exposed head of the hardwood staple. Staple receiving groove 340 of staple driving end 310 fits over the exposed hardwood staple head, forming a supportive driving surface. Body 200 has a body base surface 205. Extending downward from body base surface 205 is arm 225. Arm 225 forms a stop surface 215. Stop surface 215 forms an external angle of about 75° in relation to body base surface 205. Staple insertion edge 220 is located at the bottom of stop surface 215. Arm base surface 225 is parallel to body base surface 205.

FIG. 7 is a cross sectional view of the set tool properly located over an exposed staple head and against the edge of a hardwood plank. Hardwood staple 10 is partially driven into the side of the plank 11, leaving an exposed staple head 2. To position set tool 100, the user first puts exposed staple head 2 into staple slot 250. The user rests body 200 on a top face of plank 11 on body base surface 205, and presses staple insertion edge 215 of body 200 into the vertex of the external angle formed by the outer edge 14 of the plank, and the tongue 15 of the plank. Arm base surface 225 rests on the tongue 15 of plank 11. Rod 300 is inserted into 45° hole 230 with the two guide nubs formed by pin 355 inserted into the two channels forming staple slot 250. Thus, staple receiving groove 340 in the staple driving end 310 of rod 300 is guided to exposed staple head 2. Once the staple receiving groove 340 contacts exposed staple head 2, the user hammers on hammering end 305, and the exposed staple head 2 is finished hammered into the side of plank 11. The exposed staple head will not bend over due to close support provided by the staple slot 250.

A number of alternatives may be adopted to create a plank top set tool for hardwood staples. As previously explained, it is preferred that the rod for finish hammering the staple be thicker than the thickness of the hardwood staple, in order to allow for easy hammering. However, in other alternatives, the thickness of the rod need only be about as thick as a hardwood staple. As also previously explained, for efficient manufacturing, it is preferred that the 45° angle hole be circular so that it could be machined using standard drills, and for the rod to be cylindrical. However, the 45° angle hole could be formed in a different shape, such as a triangle or square, and have a rod of corresponding shape. The use of a square or triangular 45° angle hole and corresponding rod would prevent the rod from rotating within the hole, thus eliminating the need for guide nubs and a staple slot running the full length of the 45° angle hole.

Figure 9:
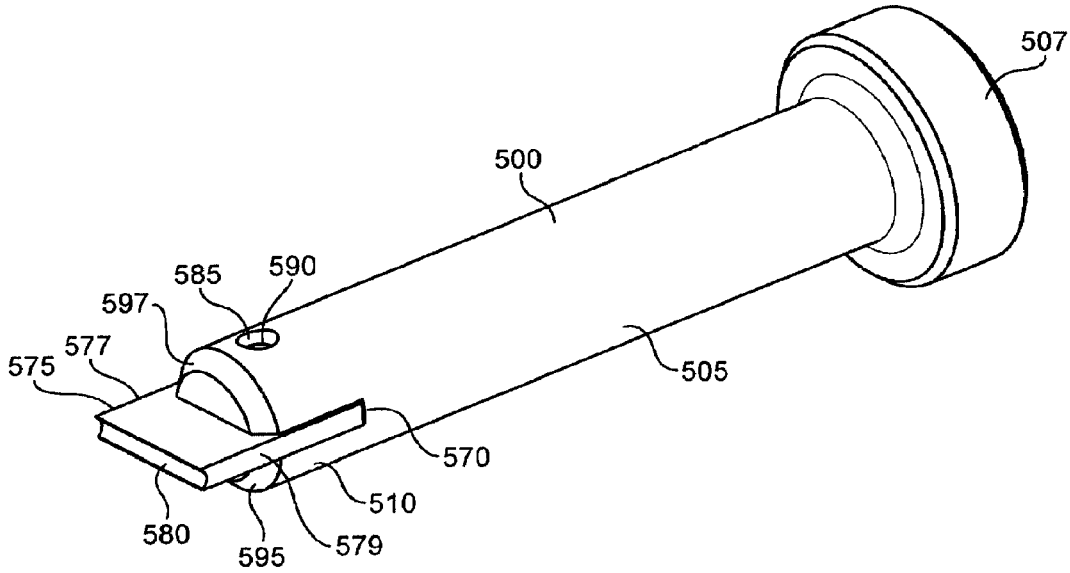
FIG. 9 is a perspective view of an alternative rod for the set tool having a thin metal tip.
Figure 10:
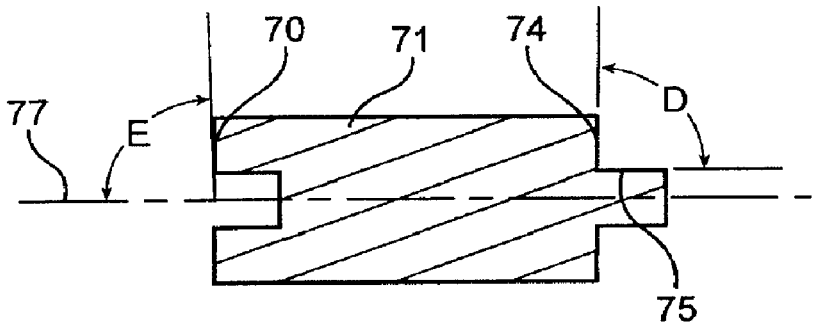
FIG. 10 is a cross section of a hardwood plank showing the angles formed by the outer edge of the plank on both the tongued side and the grooved side of the plank.
Figure 11:
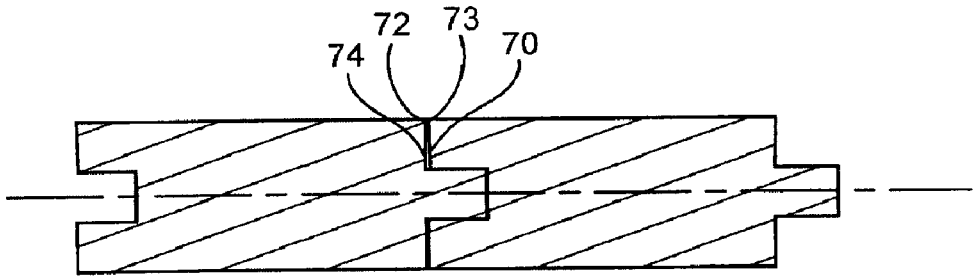
FIG. 11 is a cross section of two hardwood planks showing how the angles formed by the relieved outer edges on both the tongue and grooved sides the plank interact to prevent a gap from forming between the planks.

In a preferred embodiment, the rod includes a staple driving head having relieved edges forming an included angle shape, and an integral staple receiving groove formed in the relieved end. This configuration is preferred due to low manufacturing cost due to minimal parts. In another alternative, the set tool could include a staple driving head with a thin tip extension. As shown in FIG. 9, rod 500 has a staple driving head 510 that includes a slot 570. Inserted into slot 570 is a tip 575 that could be formed as a metal stamping from a thin piece of metal. Tip 575 has a staple receiving groove 580 formed in its end. Tip 575 is fastened to rod 500 by press fitting a pin 590 into a hole 585. Tip edges 577, 579 may form guide nubs running within a staple slot to guide the tip 575 to the top of the exposed hardwood staple head. In the finish hammering process, tip 575 is thin and easily enters the external angle formed by the outside edge of the hardwood plank, and the tongue of the plank. However, relieved edges 595, 597 in staple driving end 510 are still needed to allow the whole staple driving end to enter this external angle formed by the outer edge of the plank, and the tongue of the plank.

A thin tip such as tip 575 can have several advantages if a higher priced, more durable, and more functional set tool is desired. Rod 500 can be formed as a body 505 from a first, comparatively soft material having sufficient impact resistance for safe hammering at hammering end 507. Tip 575 may be made from a harder material which could be precision ground on the end to form a staple receiving groove 580 that conforms with the longitudinally rounded shape of the crown of the hardwood staple. Tip 575 can better drive the exposed hardwood staple head below flush into the side of hardwood plank. The lack of any exposed hardwood staple head whatsoever at the tongue and groove joint can make it easier to get the joint between planks together.

In another alternative, the rod of the set tool could incorporate a means to protect the hand from off center blows from a hammer.

In another alternative, the body of the set tool could incorporate a prying means for standing up accidentally bent over staples, or prying them out if necessary.

In another alternative, a felt pad may be added to the body base surface of the body to protect the face of the hardwood plank from being scratched.

The embodiments may be characterized in a number of different ways. For example, the device may be sold as a complete set tool, including both a body and a rod. Alternatively, the body and rod may be sold separately, requiring final assembly by a user.

What is claimed is:

1. A set tool for finish hammering an exposed head of a hardwood flooring staple having a length, width and thickness into a tongue and groove hardwood flooring plank, comprising:

a body, including:

a body base surface for resting said body on a top face of said hardwood flooring plank;

a stop surface extending at an angle from said body base surface and forming a staple insertion edge, said staple insertion edge insertable into an external angle formed by an outside edge of said hardwood flooring plank and the tongue of said hardwood flooring plank;

a staple slot configured to guide said hardwood flooring staple at substantially a 45° angle into said external angle between said outside edge and said tongue of said hardwood plank, said staple slot having an opening at said staple insertion edge, said staple slot having a width and thickness for slide fit insertion of said exposed head, said staple slot having opposed first and second surfaces spaced apart by the staple slot width and slidably fitting said hardwood flooring staple width, said staple slot further having opposed third and fourth surfaces spaced apart by the staple slot thickness and slidably fitting said hardwood flooring staple thickness; and a rod insertable into said body, said rod including:

a hammering head configured to receive impact force from a head of a hammer;

a staple driving head configured to transfer said impact force to said exposed head of said hardwood flooring staple;

wherein when said rod is inserted into said body and said exposed head of said hardwood flooring staple is inserted into said staple slot, said staple driving head of said rod is guided to said exposed head.

2. The set tool of claim 1, wherein said rod has a width greater than the width of said hardwood flooring staple.

3. The set tool of claim 2, wherein said staple slot is formed by means of two channels enlarging the perimeter of a hole formed at a 45° angle in relation to the plane formed by said base body surface, said channels having an opening at said staple insertion edge, said rod insertable into said hole, said rod including at least one guide nub insertable into said channels, said channels configured to guide said at least one guide nub of said rod such that said staple driving head of said rod is guided to said exposed staple head.

4. The set tool of claim 1, wherein said staple driving head of said rod includes a staple receiving groove configured to accept the crown of said hardwood flooring staple.

5. The set tool of claim 1, wherein said staple driving head includes relieved edges.

6. The set tool of claim 5, wherein said relieved edges in said staple driving head form an included angle of 75-90 degrees.

7. The set tool of claim 1, wherein the staple driving head includes a thin metal tip configured to slide within said staple slot to guide the staple driving head to the exposed head of said hardwood flooring staple and configured to transfer said impact force to an exposed head of said hardwood flooring staple.

8. The set tool of claim 7, wherein said tip and a rod shaft are made of different materials.

9. The set tool of claim 1, wherein the staple slot includes opposed first and second channels, the first channel having the first surface and a portion of the third and fourth surfaces and the second channel having the second surface and a further portion of the third and fourth surfaces.

10. The set tool of claim 1, wherein:

the hardwood flooring staple includes a first leg and a second leg; and the staple slot includes opposed first and second channels, the first channel being configured to guide the first leg of the hardwood flooring staple and the second channel being configured to guide the second leg of the hardwood flooring staple.

11. A stapling tool for stapling hardwood tongue and groove flooring planks into a subfloor surface, comprising:

a body, including:

a body base surface for resting said body on a top face of a one of said hardwood flooring planks;

a stop surface extending at an angle from said body base surface and forming a staple insertion edge, said staple insertion edge insertable into an external angle formed by an outside edge of said hardwood flooring plank and the tongue of said hardwood flooring plank; and a staple slot configured to guide a hardwood flooring staple at substantially a 45 degree angle into said external angle, said staple slot having an opening at said staple insertion edge; and a rod insertable into said body, said rod including:

a hammering head configured to receive impact force from the head of a hammer; and a staple driving head configured to transfer said impact force to an exposed head of said hardwood flooring staple;

wherein with said rod inserted into said body, said hardwood flooring staple being inserted to said staple slot at said staple insertion edge retracts said staple driving head.

12. The stapling tool of claim 11 wherein the staple slot includes opposing first and second channels.

13. The stapling tool of claim 11 wherein the rod is guided by the staple slot.

14. The stapling tool of claim 11 wherein the rod is guided by a rod aperture of the body aligned with the staple slot.

15. The stapling tool of claim 11, wherein said staple driving head of said rod includes a separate tip insertable into said staple slot.

16. A stapling tool for stapling hardwood tongue and groove flooring planks into a subfloor surface, comprising:

a body, including:

a body base surface for resting said body on a top face of a one of said hardwood flooring planks;

a body top surface opposite said body base surface;

a stop surface extending at an angle from said body base surface and forming a staple insertion edge, said staple insertion edge insertable into an external angle formed by an outside edge of said hardwood flooring plank and the tongue of said hardwood flooring plank; and a staple slot having a first opening at said body top surface and a second opening at said staple insertion edge, said slot configured to guide a hardwood flooring staple from the first opening to the second opening; and a rod having a portion insertable to the body at the first opening, including:

a hammering head configured to receive impact force from a head of a hammer; and a staple driving head configured to transfer said impact force to said hardwood flooring staple;

wherein said staple, inserted into said first opening followed by said rod inserted at said first opening, is driven into said hardwood flooring plank at said external angle by said staple driving head in response to said impact force, said staple being guided by said staple slot.

17. The stapling tool of claim 16 wherein the staple slot includes opposing first and second channels spanning from the first opening to the second opening.

18. The stapling tool of claim 16 wherein the rod is guided by the staple slot.

19. The stapling tool of claim 16 wherein the rod is insertable to a rod aperture of the body at the first opening, the rod aperture guiding the rod in alignment with the staple slot.

20. The stapling tool of claim 16 wherein the rod is guided by a non-cylindrical rod aperture of the body, the rod having a corresponding non-cylindrical cross-section.

21. The stapling tool of claim 16 wherein said staple driving head of said rod includes a separate tip insertable into said staple slot.

* * * * *